US006139566A

United States Patent [19]

Bennett

[11] Patent Number: 6,139,566

[45] Date of Patent: Oct. 31, 2000

[54] PACIFIER FOR INTRODUCING LIQUIDS ORALLY TO AN INFANT

[76] Inventor: LaVon L. Bennett, 354 N. 424 East, Alpine, Utah 84004

[21] Appl. No.: 09/320,740

[22] Filed: May 27, 1999

[51] Int. Cl.[7] ..... A61J 17/00

[52] U.S. Cl. ..... 606/236; 606/234

[58] Field of Search ..... 606/234, 235, 606/236

[56] References Cited

U.S. PATENT DOCUMENTS

| | | | |
|---|---|---|---|
| 4,796,628 | 1/1989 | Anderson | 606/234 |
| 5,049,127 | 9/1991 | Yen Tseng | 606/236 |
| 5,123,915 | 6/1992 | Miller et al. | 606/234 |
| 5,421,496 | 6/1995 | Korsinsky et al. | 606/234 |
| 5,843,030 | 12/1998 | Van Der Merwe | 606/236 |

*Primary Examiner*—Michael Buiz
*Assistant Examiner*—Jonathan D. Goldberg
*Attorney, Agent, or Firm*—Terry M. Crellin

[57] ABSTRACT

A pacifier which can be used to introduce liquids orally to an infant has a resilient, hollow nipple that extends from a broad, inner face of a shield plate which in turn abuts the external surfaces of the lips of an infant when the nipple is positioned in the infant's mouth. An elongate, delivery tube extends from the shield plate through the nipple. An open, distal end of the delivery tube projects through a distal end of the nipple so that the open, distal end of the delivery tube opens into the infant's mouth when the nipple is in the infant's mouth. Liquid to be administered to the infant is introduced into the proximal end of the delivery tube through a flexible tube that is rotatably attached to the proximal end of the delivery tube.

5 Claims, 2 Drawing Sheets

PACIFIER FOR INTRODUCING LIQUIDS ORALLY TO AN INFANT

BACKGROUND OF THE INVENTION

1. Field of the Invention

This invention relates generally to an devices that have been used to administer a liquid orally to an infant. In particular the invention relates to a pacifier which can be used to introduce liquids orally to an infant.

2. Prior Art

The invention is intended to facilitate administration of a viscous substance to small children, in particular to facilitate administration of contrast material to infants that are lying down in different body positions on an X-ray table. X-ray examination of infants lying down in different positions on an X-ray table is made difficult because the child has to be maneuvered on the examination table at the same time as contrast material is administered to the child. The child is often moving, crying and may be difficult to hold or otherwise restrained from moving. During the examination, it is desirable to administer as much contrast material as possible without any complications. The child must swallow as much as possible in a short time period.

It has been common procedure to administer the contrast material with a spoon or through a bottle with a sucking nipple, with the child swallowing voluntarily. This procedure is done while at the same time restraining the child. This is a tedious procedure and the administration of the contrast material may be unsatisfactorily slow because of the child resisting voluntary swallowing of the material.

A disposable sucking device having a catheter extending through the sucking device is disclosed in an article titled "Disposable Catheter Dummy" published in *Austalasian Radiology*, Vol. XV, No. 1, February, 1971. The device had a nipple formed by solid plastic material. An opening extended through the solid, hard nipple, and a flexible tube was affixed to the outer end of the opening. A syringe was used to force contrast material into the child mouth through the flexible tube and nipple. Administration of the contrast material was facilitated, but unfortunately, many children did not like the solid, hard nipple. An improvement has been suggested wherein the nipple is a hollow, elastomeric article shaped like conventional nipples on pacifiers. The flexible tube is connected to the outer end of the nipple, and the fluid is introduced into the hollow nipple. The entire nipple must be filled with fluid. However, as in the device having a solid, hard nipple, the improved device having a supple nipple had the flexible tube sticking outwardly in a direction extending directly away from the face of the child. When the child was restrained to lie on his or her stomach, the child's head had to be held up and turned sideways so that the flexible tube was free. The tubing could not kink or otherwise be bent so that the flow of viscous fluid therein was impeded. Holding the child's head in such a position did not make the procedure easy inasmuch as the child usually objected to having his or her head so held and restrained.

OBJECTS AND SUMMARY OF THE INVENTION

It is a principal object of the present invention to provide an improved device for use in administering liquid to a child, wherein the device comprises a pacifier that has a soft, resilient nipple that is readily accepted by an infant, but the nipple has a supply tube extending longitudinally through the nipple so that liquids, even relatively viscous liquids, can be forced through the tube and directly into the infant's mouth.

An additional object of the present invention is to provide a pacifier device in which liquid can be forced into an infant's mouth through a tube extending through the nipple of the pacifier, with the pacifier having means of introducing the liquid into the tube from a supply conduit that extends from the pacifier in a direction that is essentially perpendicular to the longitudinal axis of the nipple and tube, whereby the infant can be positioned lying on his or her stomach and the supply conduit can extend from the pacifier even when the infant holds his or her head so as to face downwardly toward the surface that the infant is lying on.

It is a further object of the present invention to provide a novel means of mounting the supply conduit to the tube that extends through the nipple of the pacifier, whereby the supply conduit extends from the pacifier in a direction that is essentially perpendicular to the longitudinal axis of the nipple and tube, and further wherein the supply conduit can be rotated about its end that communicates with the tube in the nipple of the pacifier in a fashion similar to the rotation of a hand of a clock.

In accordance with the present invention, the above objects are achieved by a pacifier that has a resilient nipple that extends from a shield plate as is well known in the art. In the pacifier of the present invention, an elongate, delivery tube extends through the nipple. The distal end of the delivery tube projects through the distal end of the nipple, and the proximal end of the delivery tube is positioned adjacent to a central opening through the shield plate of the pacifier. An elongate supply conduit is attached at the outer face of the shield plate so that one end of the supply conduit is located adjacent to the longitudinal axis of the delivery tube in the nipple. The supply conduit is oriented substantially perpendicular to the longitudinal axis of the delivery tube, and means are provided for connecting the inward end of the supply conduit in flow communication with the proximal end of the delivery tube.

Means are associated with the outer end of the supply conduit for attaching a flexible tube to the outer end of the supply conduit. An infant will readily suck the nipple of the pacifier, and a liquid, even a relatively viscous liquid, can be forced into the infant's mouth through the supply conduit and the delivery tube of the pacifier. The infant can be positioned so as to lie on his or her stomach and there is no need to restrain the infant's head to avoid allowing the infant to face downwardly on the surface upon which he or she is lying. Even if the infant faces downwardly on the surface upon which he or she is lying, the supply conduit extends from the pacifier along the surface upon which the infant is lying and there is no chance that the supply conduit will become kinked or otherwise obstructed.

Additional objects and features of the invention will become apparent from the following detailed description, taken together with the accompanying drawings.

DETAILED DESCRIPTION OF THE PREFERRED EMBODIMENT

Figures 1, 2:
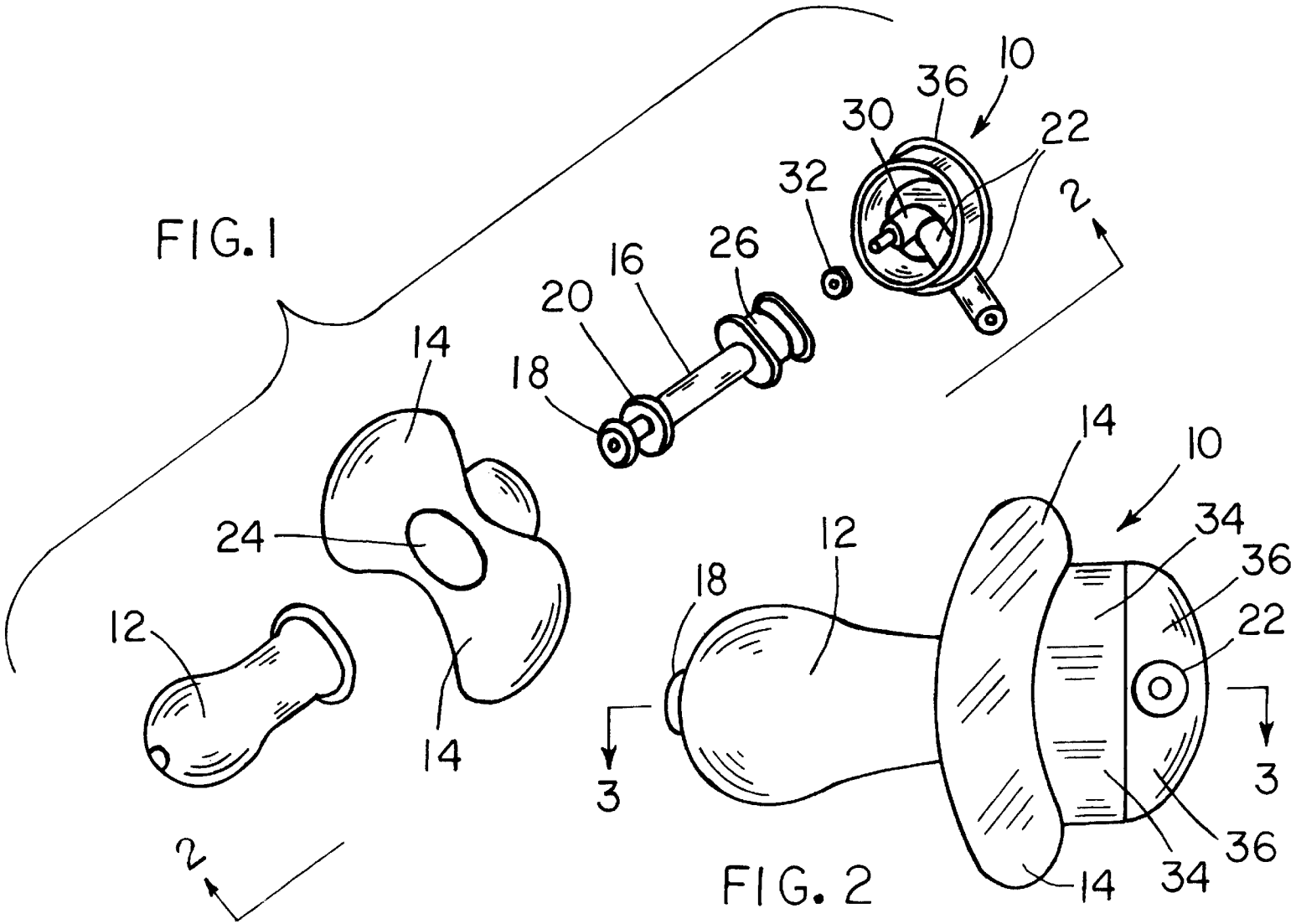
FIG. 1 is an exploded pictorial view of a pacifier made in accordance with the principles of the present invention.
FIG. 2 is a side view of the pacifier of the present invention looking in the direction of line 2 of FIG. 1 and showing the pacifier in its assembled, ready to use condition.
Figure 3:
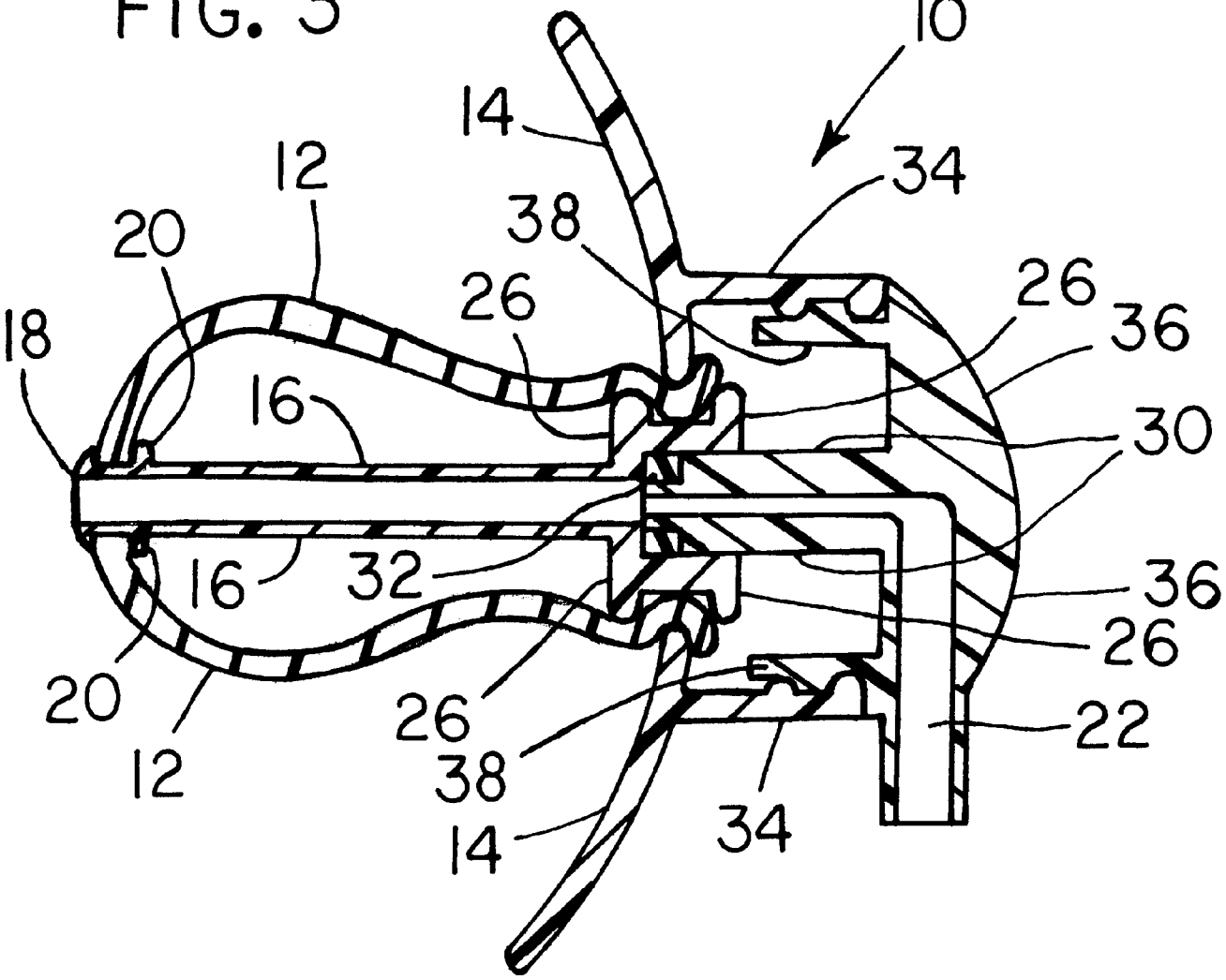
FIG. 3 is a cross sectional view of the pacifier of the present invention taken along line 3—3 of FIG. 2.

As shown in the drawings, the pacifier 10 of the present invention comprises a resilient nipple 12 that extends from a broad, inner face of a shield plate 14 as is well known in the art. The nipple 12 can take the shape of any elongate nipple that has commonly been used in commercial pacifiers that are readily available in the market. The shield plate 14 is shaped so as to have a concave surface from which the nipple 12 extends. The concave surface allows the shield plate 14 to fit smoothly about the mouth of an infant.

An elongate, delivery tube 16 extends through the nipple 12. The delivery tube 16 has an open, proximal end and an open, distal end. The proximal end of the delivery tube 16 is positioned adjacent to the shield plate 14, with the delivery tube 16 extending from the shield plate 14 through the nipple 12. The open, distal end of the delivery tube 16 projects through a distal end of the nipple 12 so that the open, distal end of the delivery tube 16 opens into an infant's mouth when the nipple 12 is positioned in the infant's mouth.

The open, distal end of the delivery tube 16 is advantageously provided with an external flange 18. The flange 18 has a generally curved external surface that blends smoothly with the external surface of the nipple 12. A second flange 20 is spaced slightly from the external flange 18. A trough is formed between the external flange 18 and the second flange 20. The external flange 18 is forced through the opening in the distal end of the nipple 12, and the perimeter of the opening in the distal end of the nipple 12 is held in place in the trough formed by the external flange 18 and the second flange 20.

An elongate, supply conduit 22 is attached to an outer face of said shield plate 14 so that a longitudinal axis of the supply conduit 22 is oriented in a plane that is substantially perpendicular to a longitudinal axis of the delivery tube 16. The supply conduit 22 has an open, first end and an open, second end, and means are provided, as explained below, for connecting the first end of the supply conduit 22 in fluid flow communication with the open, proximal end of the delivery tube. The second end of the supply conduit 22 is adapted to be connected to a flexible tube through which liquid can be fed to the pacifier 10.

The means for connecting the first end of the supply conduit 22 with the open, proximal end of the delivery tube 16, a preferred embodiment which is to be described hereinafter, allows the supply conduit 22 to pivot around its first end about an axis coincident with the longitudinal axis of the delivery tube 16 so that a longitudinal axis of the supply tube 22 always lies in a plane that is substantially perpendicular to the longitudinal axis of the delivery tube 16. The preferred, illustrated embodiment of the means for connecting the first end of the supply conduit 22 with the open, proximal end of the delivery tube 16 will now be described.

An opening 24 is provided through the shield plate 14. An enlarged hub 26 is located at the open, proximal end of the delivery tube 16. The enlarged hub 26 has a perimeter shape that is similar to the shape of the opening 24 in the shield plate 14, and the enlarged hub 26 is of a sufficient size so that it can be received within the opening 24 in the shield plate 14. An inner, open end of the nipple 12 is received over the hub 26 so that the inner, open end of the nipple 12 is wedged tightly between the enlarged hub 26 of the delivery tube 16 and the opening 24 in the shield plate 14 to firmly hold the nipple 12 and the delivery tube 16 in position extending from the inner face of the shield plate 14.

A cylindrical, hollow extension 30 projects from the first end of the supply conduit 22. The cylindrical extension 30 has (1) a first end that is integrally connected to a first end of the supply conduit 22, (2) a second end that extends from the first end of the supply conduit 22 and (3) a longitudinal axis which is oriented substantially perpendicular to a longitudinal axis of the supply conduit 22. The second end of the cylindrical extension 30 is received within the open, proximal end of the delivery tube 16 so that the cylindrical extension 30 can rotate about its longitudinal axis. Means are provided for making a fluid tight seal between the second end of the cylindrical extension 30 and the open, proximal end of the delivery tube 16. As illustrated, a resilient O-ring 32 is fit over the second end of the cylindrical extension 30 so that the O-ring makes a fluid tight seal between the cylindrical extension 30 and the delivery tube 16.

The illustrated embodiment of the pacifier 10 of the present invention further comprises a stubby, cylindrical housing 34 that extends from the outer face of the shield plate 14. The housing 34 has a center axis that coincides with the longitudinal axis of the delivery tube 16, with the housing 34 encircling the portion of the hub 26 and the end of the nipple 12 that extend from the outer face of the shield plate 14. A circular cap 36 is attached to and preferably formed integrally with the supply conduit 22 so that the supply conduit 22 extends from a center of the cap 36 through a perimeter of the cap 36, and the cylindrical extension 30 extends from the center of the cap 36 in a direction substantially coaxial with a center axis of the cap 36.

A stubby, cylindrical skirt 38 extends from the perimeter of the cap 36 so that the skirt 38 engages the housing 34 that extends from the outer face of the shield plate 14. Means are provided for securing the skirt 38 to the housing 34 so that the skirt 38 can move in a rotating motion about the housing 34. As illustrated, the skirt 38 has a ridge extending outwardly from the outer cylindrical sidewall of the skirt 38, and the ridge on the skirt 38 snaps into a corresponding indentation that extends around the inner sidewall of the housing 34.

Although preferred embodiments of the pacifier of the present invention have been illustrated and described, it is to be understood that the present disclosure is made by way of example and that various other embodiments are possible without departing from the subject matter coming within the scope of the following claims, which subject matter is regarded as the invention.

What is claimed is:

1. A pacifier which can be used to introduce liquids orally to an infant, said pacifier comprising a resilient nipple that extends from a broad, inner face of a shield plate, with said inner face of said shield plate being adapted to abut against external surfaces of lips of an infant when the the resilient nipple is positioned in a mouth of the infant;

an elongate, delivery tube having an open, proximal end and an open, distal end, said proximal end of said delivery tube being positioned adjacent to said shield plate, with said deliver tube extending from said shield plate through said resilient nipple, and further with said open, distal end of said delivery tube projecting through a distal end of said nipple so that said open, distal end of said delivery tube opens into the infant's mouth when the resilient nipple is positioned in the infant's mouth;

an elongate, supply conduit having an open, first end and an open, second end, said supply conduit being attached to an outer face of said shield plate so that a longitudinal axis of said supply conduit is oriented in a plane that is substantially perpendicular to a longitudinal axis of said delivery tube;

means for connecting said first end of said supply conduit in fluid flow communication with said open, proximal end of said delivery tube; and means associated with said second end of said supply conduit for attaching a flexible tube to said second end of said supply conduit.

2. The pacifier in accordance with claim 1 wherein said means for connecting said first end of said supply conduit with said open, proximal end of said delivery tube allows said supply conduit to pivot around its first end about an axis coincident with the longitudinal axis of said delivery tube so that a longitudinal axis of said supply tube always lies in a plane that is substantially perpendicular to the longitudinal axis of said delivery tube.

3. The pacifier in accordance with claim 2 wherein said means for connecting said first end of said supply conduit with said open, proximal end of said delivery tube comprises an opening through said shield plate;

an enlarged hub located at said open, proximal end of said delivery tube, with said enlarged hub having a perimeter shape that is similar to the shape of said opening in said shield plate, and further with said enlarged hub being of a sufficient size so that it can be received within said opening in said shield plate;

an inner, open end of said resilient nipple is received over said enlarged hub so that the inner, open end of said nipple is wedged between said enlarged hub of said delivery tube and said opening in said shield plate to firmly hold the resilient nipple and the delivery tube in position extending from the inner face of said shield plate;

a cylindrical extension projects from the first end of said supply conduit, said cylindrical extension having (1) a first end that is integrally connected to a first end of said supply conduit, (2) a second end that extends from said first end of said supply conduit and (3) a longitudinal axis which is oriented substantially perpendicular to a longitudinal axis of said supply conduit;

said second end of said cylindrical extension is received within said open, proximal end of said delivery tube so that said cylindrical extension can rotate about its longitudinal axis; and means for making a fluid tight seal between said second end of said cylindrical extension and said open, proximal end of said delivery tube.

4. The pacifier in accordance with claim 3, said pacifier further comprising a stubby, cylindrical housing extending from said outer face of said shield plate, said cylindrical housing having a center axis that coincides with the longitudinal axis of said delivery tube, with said cylindrical housing encircling the portion of said enlarged hub and said end of said resilient nipple that extend from said outer face of said shield plate;

a circular cap attached to said supply conduit so that said supply conduit extends from a center of said circular cap through a perimeter of said circular cap, and said cylindrical extension extends from the center of said circular cap in a direction substantially coaxial with a center axis of said circular cap;

a stubby, cylindrical skirt extending from the perimeter of said circular cap so that said cylindrical skirt engages said cylindrical housing that extends from said outer face of said shield plate; and means for securing said cylindrical skirt to said housing so that said cylindrical skirt can move in a rotating motion about said cylindrical housing.

5. A pacifier which can be used to introduce liquids orally to an infant, said pacifier comprising a resilient, substantially hollow nipple that extends from a broad, inner face of a shield plate, with said inner face of said shield plate being adapted to abut against external surfaces of lips of an infant when the resilient, substantially hollow nipple is positioned in a mouth of the infant;

an elongate, delivery tube having an open, proximal end and an open, distal end, said proximal end of said delivery tube being positioned adjacent to said shield plate, with said deliver tube extending from said shield plate through said resilient, substantially hollow nipple, and further with said open, distal end of said delivery tube projecting through a distal end of said resilient, substantially hollow nipple so that said open, distal end of said delivery tube opens into the infant's mouth when the resilient, substantially hollow nipple is positioned in the infant's mouth; and means associated with said proximal end of said delivery tube for attaching a flexible tube to said proximal end of said delivery tube.

* * * * *

UNITED STATES PATENT AND TRADEMARK OFFICE

CERTIFICATE OF CORRECTION

PATENT NO : 6,139,566

DATED : October 31, 2000

INVENTOR(S) : Elizabeth A. McCarty & Michael P. Erzen

It is certified that error appears in the above-identified patent and that said Letters Patent are hereby corrected as shown below:

Column 6, Claim 1, line 49, delete "adjustable" and insert --adjustably--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*